US008410029B2

(12) United States Patent
Miyasaka

(10) Patent No.: US 8,410,029 B2
(45) **Date of Patent: *Apr. 2, 2013**

(54) SURFACE-OXIDE ABRASION-RESISTANT LUBRICANT COATING AND METHOD FOR FORMING THE SAME

(75) Inventor: Yoshio Miyasaka, Nagoya (JP)

(73) Assignee: Fuji Kihan Co., Ltd., Nagoya-Shi, Aichi (JP)

( * ) Notice: Subject to any disclaimer, the term of this patent is extended or adjusted under 35 U.S.C. 154(b) by 160 days.

This patent is subject to a terminal disclaimer.

(21) Appl. No.: 12/379,948

(22) Filed: Mar. 5, 2009

(65) Prior Publication Data

US 2009/0312206 A1 Dec. 17, 2009

(30) Foreign Application Priority Data

Jun. 11, 2008 (JP) ..... 2008-153368

(51) Int. Cl.
*F16C 33/12* (2006.01)
*B05D 3/00* (2006.01)
*B32B 15/00* (2006.01)

(52) U.S. Cl. ..... 508/103; 508/108; 508/154; 427/299; 428/469; 428/689; 428/697; 428/701

(58) Field of Classification Search ..... 508/154, 508/103, 108; 427/299; 428/469, 689, 697, 428/701

See application file for complete search history.

(56) References Cited

U.S. PATENT DOCUMENTS 4,975,243 A 12/1990 Scott et al.
5,352,540 A 10/1994 Schienle et al.

(Continued)

FOREIGN PATENT DOCUMENTS

EP 0 922 786 A2 6/1999
EP 0 933 447 B1 5/2002

(Continued)

OTHER PUBLICATIONS

Prakash et al., "The Lubiricity of Oxides Revised Based on a Polarisability Approach", Tribol Lett (2007) vol. 27, published May 3, 2007, pp. 105-112.

(Continued)

*Primary Examiner* — Ellen McAvoy
*Assistant Examiner* — Vishal Vasisth
(74) *Attorney, Agent, or Firm* — Shlesinger, Arkwright & Garvey LLP

(57) ABSTRACT

The present invention provides a surface-oxide abrasion-resistant lubricant coating that can maintain high lubricity for a long time without wear of a base material and a coating or damage to an object to be contacted by a simpler method and with less expensive material. A mixed fluid of a compressed gas and fine-particle powders of two soft metals having lower hardness and lower melting point than the base material of a sliding contact portion is ejected onto a surface of the sliding contact portion. The fine-particle powders of the soft metals are made to react with oxygen in the compressed gas at the surface of the sliding contact portion to form a metal-oxide film with high melting point composed of metal oxides of the two soft metals, one of the metal oxides having higher hardness than the other. This metal-oxide film with high melting point includes a coating having a thickness of 0.1 μm to 2 μm at an interface toward an object to be contacted, that is composed of the metal oxides, that has low friction resistance and low shear resistance, and shear fractures concentrated the coating thereto.

18 Claims, 4 Drawing Sheets

U.S. PATENT DOCUMENTS

| | | | | |
|---|---|---|---|---|
| 6,863,922 | B2 | 3/2005 | Ogihara et al. | |
| 6,913,207 | B2 | 7/2005 | Miyamoto et al. | |
| 2002/0009542 | A1* | 1/2002 | Miyasaka | 427/191 |
| 2002/0055005 | A1* | 5/2002 | Miyasaka | 428/472 |
| 2007/0134468 | A1 | 6/2007 | Buehler | |

FOREIGN PATENT DOCUMENTS

| | | |
|---|---|---|
| JP | 05-086443 | 4/1993 |
| JP | 10-176615 | 6/1998 |
| JP | 11-131257 | 5/1999 |
| JP | 11-236677 | 8/1999 |
| JP | 2000-282259 | 10/2000 |
| JP | 2002-161371 | 6/2002 |
| JP | 2005-054237 | 3/2005 |
| JP | 2007-270186 | 10/2007 |
| JP | 2009-007602 | 1/2009 |

OTHER PUBLICATIONS

Buyanovskii et al., "Some Specific Methods of Organizing Two-Layer Lubrication", Chemistry and Technology of Fuels and Oils, vol. 36, No. 1, 2000, pp. 37-47.

EPO Communication of Oct. 29, 2009 with European Search Report of Oct. 6, 2009.

* cited by examiner

SURFACE-OXIDE ABRASION-RESISTANT LUBRICANT COATING AND METHOD FOR FORMING THE SAME

BACKGROUND OF THE INVENTION

1. Field of the Invention

The present invention relates to a surface-oxide abrasion-resistant lubricant coating and a method for forming the same. In particular, the present invention relates to a surface-oxide abrasion-resistant lubricant coating capable of not only enhancing properties, such as the abrasion resistance and the lubricity of a metal part (hereinafter, referred to as a "sliding contact part", such as a mechanical part, a mold, and a cutting tool, that is used in slidable contact with an object to be contacted serving as a counterpart to be slidingly contacted, but also reducing the occurrence of wear, damage, and so forth of the object to be contacted by reinforcing a contact portion (hereinafter, referred to as a "sliding contact portion") of the sliding contact part and improving the lubricity of the sliding contact portion and to a method for forming such a surface-oxide abrasion-resistant lubricant coating.

2. Description of the Related Art

Fluid lubricants, such as oil and grease are typically used for the lubrication of sliding contact portions. However, it may not be possible to use such fluid lubricants for design reasons or due to restrictions imposed by the operating environments, such as vacuum conditions, in which fluids or absorbed gases easily evaporate or desorb. Furthermore, with the recent growing consciousness of environmental issues, minimized use of fluid lubricants is desired because leakage of such fluid lubricants out of machines may lead to environmental disruption.

In response to these demands, solid lubricants are being increasingly used for lubrication instead of fluid lubricants. Examples of such solid lubricants include layered structures such as graphite (C), molybdenum disulfide ($MoS_2$), tungsten disulfide ($WS_2$), and boron nitride (BN).

In fact, in order to enhance the lubricity at a sliding contact portion by forming a coating made of such a solid lubricant over the surface of the sliding contact portion, the present inventor has proposed a method for forming an abrasion-resistant coating by ejecting powders of a solid lubricant, such as zinc, molybdenum disulfide, or tin, onto the surface of the object to be processed at a predetermined ejection pressure and ejection speed to diffuse and penetrate elements in the composition of the solid lubricant over the surface of the sliding contact portion (Japanese Patent No. 3357586).

For the formation of a solid-lubricant coating by ejecting such powders, the present inventor has also proposed a technique for ejecting a mixture of metal particles, such as tin, making up a base phase of the coating to be formed and particles of a solid lubricant such as molybdenum disulfide to form a coating having the solid lubricant dispersed in the base phase (Japanese Patent No. 3357661).

Problems with Known Layered-Structure Solid Lubricants

Limitation of Effects

Of the above-described solid lubricants, layered-structure solid lubricants such as graphite, molybdenum disulfide, tungsten disulfide and boron nitride exhibit their lubricity as a result of being decomposed into layers due to frictional contact with a sliding contact portion. However, such solid lubricants themselves do not have fluidity, unlike fluid lubricants such as oil or grease. For this reason, once decomposed, solid lubricants cannot restore their original states. This means that solid lubricants lose their lubricity once their decomposition is completed.

To overcome this problem, a system for additionally supplying a solid lubricant, when necessary, to an interface contacted with an object to be contacted serving as a counterpart to be contacted is necessary in order to allow such layered-structure solid lubricants to keep exhibiting lubricity for an extended period of time.

In regard to this point, for the invention disclosed in the Japanese Patent No. 3357661, the coating formed over the surface of a sliding contact portion is constructed such that a solid lubricant such as molybdenum disulfide is dispersed in soft metal such as tin that serves as a base phase. With this structure, molybdenum disulfide that is unbroken and that has been dispersed in the base phase such as tin emerges over the interface contacted with the object to be contacted as a result of the base phase being worn away, thereby restoring the lubricity of the molybdenum disulfide.

However, regardless of adoption of such a structure, the lubricity of a layered-structure solid lubricant such as molybdenum disulfide is restricted by the total amount of the layered-structure solid lubricant dispersed in the coating.

High Cost or Difficulty in Handling

The above-described layered-structure solid lubricants are generally expensive, except for graphite. In recent years particularly, a rapid increase in the number of cars manufactured in developing countries has stimulated the demand for molybdenum disulfide, and molybdenum disulfide is becoming not only more expensive but also more difficult to obtain.

For this reason, if such expensive molybdenum disulfide, tungsten disulfide, or boron nitride is used as a solid lubricant, the product price itself will surge, resulting in disadvantageous in terms of price competitiveness in the market.

On the other hand, among the above-described layered-structure solid lubricants, graphite is advantageous in terms of price over the other layered-structure solid lubricants. However, fine particles of graphite are difficult to handle because they are prone to dust fires or dust explosions. In particular, if graphite powder is ejected together with a compressed gas using a blasting machine as described in Japanese Patent No. 3357661, the blasting needs to be carried out under controlled conditions to prevent such a dust fire from occurring, and the use of graphite is limited for this reason.

Problems with Soft-Metal Coatings

Restrictions Imposed by Base Material

Ways of enhancing lubricity without using layered-structure solid lubricants as described above may include forming a coating of soft metal, such as tin, over the surface of a sliding contact portion.

Referring to FIGS. 4A to 4C for explaining the principle behind enhanced lubricity of the sliding contact portion by forming a coating of soft metal, the frictional force can be given by the product of the area A and the shearing strength s ($A \times s$) of a portion condensed and solidified. In the example of FIG. 4A where hard metal is rubbed against soft metal, the shearing strength s decreases mainly because the soft metal is easily subjected to plastic deformation. However, the total frictional force represented by $A \times s$ does not decrease because the area A of the portion condensed and solidified increases due to the deformation of the soft metal.

Similarly, in the example of FIG. 4B where hard metal is rubbed against hard metal, even though the area A of the portion condensed and solidified is small because the hard metal is subjected to only minor plastic deformation, the frictional force represented by $A \times s$ does not decrease because the shearing strength s is high.

In contrast, in the example shown in FIG. 4C where a coating of soft metal is formed over hard metal, the area A of the portion condensed and solidified is small because the weight is supported by the underlying hard metal. Furthermore, because the shearing strength s is determined based on the soft metal formed over the surface, the product of A and s, that is, the friction resistance decreases.

According to the principle behind the decreased friction resistance by forming a coating of such soft metal, the lubricity achieved by forming a coating of soft metal is exhibited when the coating of soft metal is formed over relatively hard base material which has the property that no plastic deformation occurs at the time of contact with an object to be contacted. In other words, if the hardness of the base material is so low that the base material itself is subjected to plastic deformation at the time of contact with an object to be contacted, the coating of soft metal formed over the surface will exhibit only limited enhancement of lubricity.

Loss of Lubricity Due to Wear of a Coating

Enhancement of lubricity achieved by forming a coating of soft metal is seen in the form of continuous lubricity that is exhibited when soft metal with low shearing strength formed as a coating over the surface of base material undergoes repeated movement and transfer due to plastic deformation and restores the original surface. However, while repeating the above-described movement and transfer, such soft metal becomes unable to restore the original surface and is finally ejected from between the interfaces to be contacted in the form of abrasion powder. In this manner, the coating of soft metal is gradually worn away, or such abrasion powder gradually increases in amount, thus eventually losing its lubricity.

Such abrasion powder is generated probably as a result of transferred particles hardening through interaction with oxygen in the air at the friction surface.

More specifically, while being repeatedly moved and transferred in the form of transferred particles at the time of friction, the soft metal formed as a coating absorbs or chemically combines with oxygen in the air, and these transferred particles harden so that they lose plastic deformability and become unable to restore the original surface. Furthermore, the transferred particles hardening in this manner scrape the surface of the coating of soft metal or, in some cases, the object to be contacted serving as a counterpart to be contacted, to grow like a rolling snowball to such a degree that they cannot remain between the interfaces to be contacted and are ejected from between the interfaces to be contacted.

Such abrasion powders generated based on the mechanism described above cause the coating of soft metal to be gradually worn out and lose its lubricity, and moreover, transferred powder hardening as a result of oxidation damages the base material or the object to be contacted serving as a counterpart to be contacted.

In light of the shortcomings of lubrication inherent to the formation of a soft-metal coating, the inventor of the present invention hypothesized that high lubricity of a coating can be maintained for an extended period of time while still preventing the base material and the object to be contacted serving as a counterpart to be contacted from being damaged by forming a coating that exhibits high-hardness at the base material and exhibits low friction resistance and low shear resistance at the interface contacted with the object to be contacted, as well as by preventing the hardening of transferred particles generated at the time of sliding contact.

Coatings that not only exhibit high hardness at the base material and low hardness at the interface contacted with the object to be contacted but also prevent transferred particles from hardening, as described above, may be realized by the following procedure. The surface of the sliding contact portion is reinforced in advance by forming a hard layer over the surface of the sliding contact portion through carburization or nitriding or by forming a ceramic coating through CVD, PVD or the like, and this reinforced surface of the sliding contact portion is then plated with precious metal such as gold (Au) or silver (Ag) which is a relatively soft and stable substance not oxidized in the air.

However, if a coating is to be formed via this method, not only is a large, costly processing apparatus for carburization, nitriding, CVD, or PVD needed, but also a plurality of different processes including surface reinforcement and plating of precious metal must be combined to form the coating.

In addition, precious metal such as gold or silver that is the material of the coating formed over the interface contacted with the object to be contacted is expensive, and the price of the product itself having such a coating formed thereon rises accordingly, thus jeopardizing the price competitiveness in the market.

In view of these circumstances, the present invention is intended to provide a surface-oxide abrasion-resistant lubricant coating that can not only achieve high lubricity maintainable for an extended period of time but also prevent a base material and a coating from being worn out and an object to be contacted serving as a counterpart to be contacted from being damaged, via a simpler method and with less expensive material. The present invention is also intended to provide a method for forming such a surface-oxide abrasion-resistant lubricant coating without having to use a large apparatus, as well as via a simpler method.

SUMMARY OF THE INVENTION

To achieve the above-described objects, a surface-oxide abrasion-resistant lubricant coating according to the present invention comprises two metal oxides with high melting point that are produced as a result of fine-particle powders of two respective soft metals, each having lower hardness and lower melting point than a base material of a sliding contact portion, reacting with oxygen in a compressed gas at a surface of the sliding contact portion such that one of the two metal oxides has relatively higher hardness than the other, wherein the coating is formed at an interface which is contacted with an object to be contacted, and on the surface of the sliding contact portion, the coating has low friction resistance and low shear resistance, and shear fractures concentrated the coating thereto, and the coating has a thickness of 0.1 μm to 2 μm.

The surface-oxide abrasion-resistant lubricant coating may comprises one of two metal oxides with high melting point that are produced as a result of fine-particle powders of two respective soft metals mixed with a compressed gas, each of the soft metals having lower hardness and lower melting point than a base material of a sliding contact portion, reacting with oxygen in the compressed gas at a surface of the sliding contact portion such that one of the two metal oxides has higher hardness than the other, wherein said one of the two metal oxides which forms the coating has lower hardness than the other at an interface which is contacted with an object to be contacted, and on the surface of the sliding contact portion, the coating has low friction resistance and low shear resistance, and shear fractures concentrated the coating thereto, and the coating has a thickness of 0.1 μm to 2 μm.

A method for forming a surface-oxide abrasion-resistant lubricant coating according to the present invention includes colliding a mixed fluid of a compressed gas and fine-particle powders of two soft metals having lower hardness and lower melting point than a base material of a sliding contact portion with a surface of the sliding contact portion at an ejection pressure of 0.58 MPa or more or at an ejection speed of 200 m/sec or more; reacting the fine-particle powders of two soft metals with oxygen in the compressed gas at the surface of the sliding contact portion; forming a metal-oxide film with high melting point, the metal-oxide film being composed of two metal oxides originating from the two respective soft metals such that one of the two metal oxides has higher hardness than the other; and forming a coating having a thickness of 0.1 μm to 2 μm at an interface contacted with an object to be contacted of the metal-oxide film with high melting point, that is composed of the metal oxides, that has low friction resistance and low shear resistance, and shear fractures concentrated the coating thereto.

When an ejection speed of fine-particle powders of the soft metal that becomes the metal oxide having relatively lower hardness is relatively lower than an ejection speed of the fine-particle powder of the soft metal that becomes the metal oxide having relatively higher hardness between the above mentioned soft metals that become the metal oxides having relatively lower and higher hardness resulting from oxidation, the metal oxides with high melting point, one of the metal oxides having higher relatively hardness and the other having relatively lower hardness as a result of oxidation, can be mixed at the interface which is contacted with the object to be contacted, and on the surface of the sliding contact portion to form a coating in which the coverage of the metal oxide with relatively lower hardness as a result of oxidation is at least 80%.

A sliding contact portion whose base material has a hardness of Hv450 or more is preferably subjected to the following pre-treatment. That is, shots having a particle diameter of 20 μm to 200 μm and hardness equal to or higher than the hardness of the base material of the above-described sliding contact portion and that are substantially spherical shape should preferably be collided with the surface of the sliding contact portion at an ejection speed of 100 m/sec to 250 m/sec or at an ejection pressure of 0.3 MPa to 0.6 MPa in one or more processes to form a large number of minute concavities having a diameter of 0.1 μm to 5 μm and arched in cross section in the surface of the sliding contact portion.

According to the present invention, the following reinforced coating having high lubricity and abrasion resistance when in contact with the object to be contacted can be obtained via the surface of the sliding contact portion in the form of a surface-oxide abrasion-resistant lubricant coating (hereinafter, the "surface-oxide abrasion-resistant lubricant coating" according to the present invention is referred to simply as "oxide film"). That is, the coating is formed of a metal oxide having a thickness of 0.1 μm to 2 μm at the interface contacted with the object to be contacted, that has low friction resistance and low shear resistance, and shear fractures concentrated the coating thereto (hereinafter also called "concentrated shear fractures).

Furthermore, the coating having the concentrated shear fractures has a thickness of 0.1 μm to 2 μm, and the lower layer (the base material side) of the coating having the concentrated shear fractures has relatively high hardness because a metal oxide with relatively high hardness can be obtained as a result of oxidation. Therefore, even if the base material of the sliding contact portion is relatively soft, the cross-section A (refer to FIG. 4) of the portion condensed and solidified can be made small, thus reducing the frictional force, which is represented by the product (A×s) of the area A and the shearing strength s of the portion condensed and solidified.

In addition, the "oxide film" formed in this manner generates only a small amount of abrasion powder regardless of long-term usage, thus reducing wear of the "oxide film" and damage to the surface of the object to be contacted serving as a counterpart to be contacted.

An "oxide film" having excellent properties as described above can be formed by a relatively simple method, namely, by colliding a mixed fluid of a compressed air and fine-particle powders of soft metals with the surface of the sliding contact portion.

A shear fracture can be concentrated at the interface contacted with the object to be contacted by causing the above-described metal oxide with relatively low hardness as a result of oxidation to have a hardness that is equal to or less than one-fourth of the hardness of the above-described metal oxide with relatively high hardness as a result of oxidation.

If the base material of the sliding contact portion has a hardness of Hv450 or more, then a large number of minute concavities having a diameter of 0.1 μm to 5 μm and arched in cross section can be formed on the surface of the sliding contact portion to form concavities corresponding to these concavities in the "oxide film". These concavities function as oil reservoirs to prevent oil film from running out during lubrication to exhibit higher lubricity.

Not only can the soft metals be oxidized satisfactorily but also the formed "oxide film" can be endowed with a large adhesion to the sliding contact portion by colliding the mixed fluid with the above-described sliding contact portion at a pressure of 58 MPa or more or at an ejection speed of 200 m/sec or more.

Particle powders of soft metals with an average particle diameter of 10 μm to 100 μm are used for this ejection, thereby the fine-particle powders of the soft metals can easily be blown in the compressed gas flow, which makes it possible to secure energy required at the time of collision.

Ejection conditions, such as the ejection pressure or the ejection speed of fine-particle powders of the two metals can be made the same by employing a combination of metals similar to each other in or in any one of hardness, density, and specific gravity and melting point as the two soft metals constituting fine-particle powders of soft metals, which helps simplify the process of forming the "oxide film".

A coating formed of a metal oxide having concentrated shear fractures can be reliably formed at the interface contacted with the object to be contacted of the formed "oxide film" by colliding a fine-particle powder of a soft metal that becomes a metal oxide with relatively high hardness as a result of oxidation with the surface of the above-described sliding contact portion and then by colliding a fine-particle powder of a soft metal that becomes a metal oxide with relatively low hardness as a result of oxidation with the surface of the above-described sliding contact portion.

By realizing a soft metal that becomes a metal oxide with relatively low hardness as a result of oxidation by, for example, a soft metal that has lower density and lower specific gravity than a soft metal that becomes a metal oxide with relatively high hardness as a result of oxidation, a metal oxide having relatively low hardness, low density, and low specific gravity as a result of the oxidation can be precipitated on the interface (the surface side) contacted with the object to be contacted with a coverage of 50% or more, preferably, about 80%, even in a case where a mixture of fine-particle powders of the two soft metals is collided with the surface of the above-described sliding contact portion. Thus, an "oxide film" having concentrated shear fractures can be formed at the interface (the surface side) contacted with the object to be contacted by simplified processing, namely, merely by ejecting fine-particle powders of soft metals in one process. This is probably because the metal having higher hardness and higher specific gravity is diffused and penetrated into and adhered onto the lower layer of the coating.

If the base material of the sliding contact portion has a hardness of Hv450 or more, a large number of minute concavities having a diameter of 0.1 μm to 5 μm and arched in cross section can be formed on the surface of the sliding contact portion by carrying out pre-treatment, more specifically, by colliding shots having a particle diameter of 20 μm to 200 μm and hardness equal to or higher than the hardness of the base material of the above-described sliding contact portion and that are substantially spherical shape with the surface of the sliding contact portion at an ejection speed of 100 m/sec to 250 m/sec or at an ejection pressure of 0.3 MPa to 0.6 MPa in one or more processes. As a result, a large number of minute concavities functioning as oil reservoirs can be formed also at the surface of the "oxide film" formed over this sliding contact portion.

BRIEF DESCRIPTION OF THE DRAWINGS

The objects and advantages of the invention will become apparent from the following detailed description of preferred embodiments thereof provided in connection with the accompanying drawings in which.

DETAILED DESCRIPTION OF THE PREFERRED EMBODIMENTS

Embodiments according to the present invention will now be described.

In pursuit of a coating that not only has high hardness at a base material and low hardness at the interface contacted with the object to be contacted but also prevents transferred particles from hardening, as well as a method for forming such a coating via a simpler process and with less expensive material, the inventor of the present invention obtained findings of the present invention as a result of experiments conducted in consideration of the following properties of soft metals and oxides thereof.

More specifically, if described by way of example of tin (Sn) and zinc (Zn) as soft metals, tin has a Mohs hardness of 3 to 2, whereas zinc has a Mohs hardness of about 4. Thus, both tin and zinc are soft metals that have similar hardnesses.

However, for oxides generated as a result of these soft metals reacting with oxygen, the hardness of tin oxide increases up to about Hv1650, whereas the hardness of zinc oxide is as low as about Hv200, which is much lower than the hardness of the tin oxide. As a result, when compared on the basis of oxides, the tin oxide and the zinc oxide exhibit a great difference in hardness from each other.

Because the zinc oxide with relatively low hardness resulting from oxidation has already been oxidized, it is unlikely to further harden in chemical reaction with oxygen in the air.

Furthermore, tin and zinc are similar to each other in some properties. More specifically, tin has a specific gravity of 7.298 and a melting point of 231.9° C., whereas zinc has a specific gravity of 7.133 and a melting point of 419.46° C. This means that tin and zinc can be handled under similar conditions.

Figures 4A, 4B, 4C:
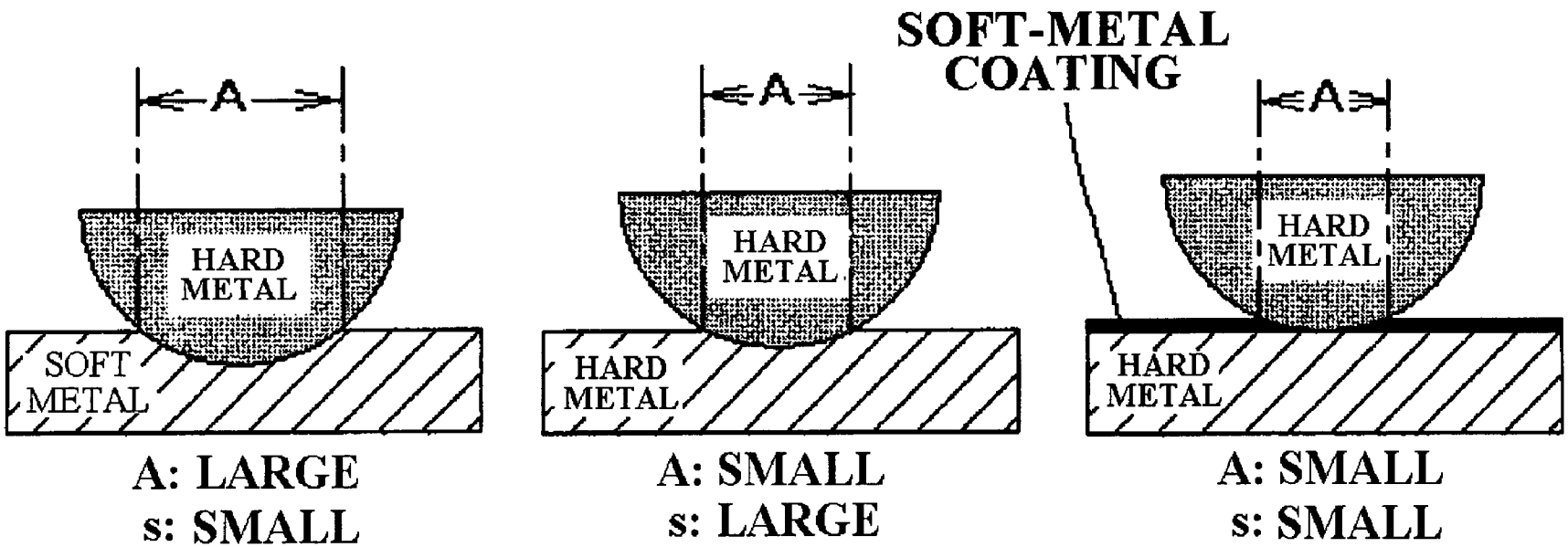
FIGS. 4A to 4C are diagrams illustrating the relationship of the area A, the shearing strength s, and the frictional force of an portion condensed and solidified where a soft base material is formed (FIG. 4A), a hard base material is formed (FIG. 4B), and a soft coating is formed over a hard base material (FIG. 4C).

Based on the above-mentioned considerations, the inventor of the present invention obtained further findings that the frictional force at an portion condensed and solidified can be decreased by reducing the area A of the portion condensed and solidified (refer to FIGS. 4A to 4C) and that the exfoliation of a coating and damage to the surface of an object to be contacted serving as a counterpart to be contacted resulting from hardening of transferred particles generated by a shear fracture can be prevented by forming, over a sliding contact portion, a coating that includes one metal oxide (tin oxide) with relatively high hardness resulting from oxidation at the base material and another metal oxide (zinc oxide) with relatively low hardness resulting from oxidation at the interface contacted with the object to be contacted serving as a counterpart to be contacted (the surface) to form a coating having concentrated shear fractures at the interface contacted with the object to be contacted. According to these findings, the inventor has completed the present invention that relates to such a coating and a method for forming said coating.

Structure of an "Oxide Film"

Overall Structure

From the description above, the "oxide film" according to the present invention is a metal-oxide film with high melting point that is formed of two metal oxides, one having relatively high hardness and the other having relatively low hardness, generated as a result of oxidation of two respective soft metals by causing fine-particle powders of the two soft metals with lower hardness and lower melting point than those of the base material at the sliding contact portion to react with oxygen in a compressed gas on the surface of the sliding contact portion.

This metal-oxide film with high melting point includes a coating having the following features. That is, the coating having a thickness of 0.1 μm to 2 μm at the interface contacted with the object to be contacted serving as a counterpart to be contacted is formed of a metal oxide (accounting for approximately 80% or more in coverage) with relatively low hardness resulting from oxidation, has low friction resistance and low shear resistance, and concentrated shear fractures.

Constituent Metals of Fine-Particle Powders

For the two soft metals constituting the above-described fine-particle metal powders, any combinations of two soft metals with the following characteristics can be employed. That is, the two soft metals should have lower hardness and lower melting point than those of the base material, and should generate their respective oxides in reaction with oxygen, one of the two oxides having relatively high hardness and the other having relatively low hardness. Preferably, a combination in which the hardness of the metal oxide with relatively low hardness as a result of oxidation is equal to or less than one-fourth of that of the metal oxide with relatively high hardness as a result of oxidation is selected.

Examples of such a combination of soft metals include a combination of tin (Sn) and zinc (Zn).

As described above, tin and zinc in their pure-metal states have relatively similar properties to each other, including hardness, melting point, density, and specific gravity. On the other hand, oxides of tin and zinc formed as a result of reaction with oxygen exhibit a relatively large difference in hardness, i.e., the hardness values of the oxides differ from each other by more than a factor of four. Therefore, the combination of tin and zinc is suitable as the material of the intended "oxide film".

Alternatively, other combinations, such as a combination of aluminum (Al) and zinc, are also applicable.

Structure of the Interface Contacted with the Object to be Contacted

The "oxide film" to be formed in this embodiment includes a coating that is formed of a metal oxide (zinc oxide in the above-described example) measuring 1 μm to 0.1 μm at the interface (surface) contacted with the object to be contacted and having relatively low hardness and concentrated shear fractures.

A film that includes a coating having concentrated shear fractures may be realized in a two-layer structure including a first layer of a metal oxide with relatively high hardness (e.g., a tin oxide) formed over the surface of the sliding contact portion of a sliding contact part and a second layer of a metal oxide with relatively low hardness (e.g., a zinc oxide) formed over the first layer. Alternatively, such a film may be realized in a single-layer structure including a high content of a metal oxide with relatively high hardness at the base material and a high content of a metal oxide with relatively low hardness at the interface (surface) contacted with the object to be contacted.

Method for Forming Coatings

Fine-particle powders of the above-described two soft metals can be made to react with oxygen in a compressed gas and to adhered to the surface of the sliding contact portion by colliding the fine-particle powders of the two soft metals with the surface of the sliding contact portion as a mixed fluid with a compressed gas.

When the fine-particle powders of soft metals are collided with the surface of the above-described sliding contact portion in this manner, the above-described soft metals are oxidized with heat generated by the impact at the time of collision and are adhered to the surface of the sliding contact portion to form a coating of metal oxides.

The ejection conditions at this time are as follows. Metal particles of the above-described soft metals are collided with the surface of the above-described sliding contact portion with a compressed gas including oxygen (e.g., compressed air) at an ejection pressure of 0.58 MPa or more or at an ejection speed of 200 m/s or more.

The particle diameter of fine-particle powders of soft metals used as ejected powders is 10 μm to 100 μm, preferably, 30 μm to 60 μm. With a particle diameter within this range, the fine particles of soft metals used as ejected powder are blown by the compressed gas more easily, which makes it possible to generate collision energy necessary for oxidation and adhesion to the surface of the sliding contact portion.

In particular, if soft-metal powders are realized by the combination of tin and zinc, as described above, then processing under the same blasting conditions, including the ejection pressure and the ejection speed, can be carried out to simplify the procedure by making other conditions, such as the particle diameter, the same as or similar to each other, because tin and zinc are originally similar to each other in terms of specific gravity, hardness, and melting point.

Ejection of fine-particle powders of soft metals onto the surface of the sliding contact portion may be carried out in the following order. First, fine-particle powders (tin powders in the above-described example) of a soft metal that has relatively high hardness as a result of reaction with oxygen are collided with the surface of the sliding contact portion to form a first metal-oxide film with relatively high hardness, and then fine-particle powders (zinc powders in the above-described example) of a soft metal that has relatively low hardness as a result of reaction with oxygen are collided with the first metal-oxide film to form a second metal-oxide film with relatively low hardness over the first metal-oxide film with relatively high hardness.

Alternatively, a mixture of fine-particle powders of one soft metal that has relatively high hardness and another soft metal that has relatively low hardness as a result of reaction with oxygen may be collided with the surface of the above-described sliding contact portion to form an "oxide film" including a mixture of both the metal oxides.

If a mixture of fine-particle powders of two soft metals is to be collided with the surface of the above-described sliding contact portion, as described above, then the combination of two soft metals, one having lower specific gravity than the other, may be employed, instead of the combination of a soft metal that has relatively low hardness as a result of oxidation and a soft metal that has relatively high hardness as a result of oxidation.

If a mixture of fine-particle powders of two soft metals that differ from each other, for example, in terms of specific gravity is to be collided with the surface of the above-described sliding contact portion, as described above, then the metal oxide with relatively low hardness is collected in a larger amount at the surface of the formed "oxide film" due to differences in hardness and specific gravity or a difference in hardness, which makes it possible to form a coating having concentrated shear fractures at the surface (interface contacted with the object to be contacted) of the formed "oxide film".

Pre-Treatment

If the hardness of the base material serving as the object to be processed is Hv450 or more, then the following pre-treatment may be carried out on the surface of the sliding contact portion of the sliding contact part before the formation of an "oxide film" with the above-described fine-particle powders of soft metals. Specifically, shots having a particle diameter of 20 μm to 200 μm and a hardness equal to or higher than that of the base material and that are substantially spherical shape may be collided with the surface of the sliding contact portion at an ejection speed of 100 to 250 m/s or at an ejection pressure of 0.3 to 0.6 MPa in one or more processes to form a large number of minute concavities arched in cross section in the surface of the sliding contact portion.

The minute concavities formed here are arched in cross section having a diameter of 0.1 μm to 5 μm. The concavities formed on the base material in this manner emerge on the surface of the "oxide film" abrasion-resistant coating formed thereover to be functioned as oil reservoirs for effectively preventing an oil film from running out when the interface to be contacted is to be lubricated.

Such concavities can also be formed on a sliding contact part with a base material hardness of less than Hv450. However, if the hardness of the base material is less than Hv450, concavities can be formed on the surface of the sliding contact portion by directly ejecting fine-particle powders of soft metals without carrying out the above-described pre-treatment. This means that the pre-treatment described above can be omitted.

Examples of shots to be ejected onto a sliding contact portion with a base material hardness of Hv450 or more include metals such as steel, white alundum (WA), or high-speed steel; metal and ceramic; ceramic; or glass. Alumina-silica beads harder than glass or glass beads are preferable.

Furthermore, the shape of the shots is as perfectly spherical shape as possible to form superior concavities arched in cross section, so that the concavities effectively function as excellent oil reservoirs, as will be described later. If the shots are rectangular, the shape of the concavities is not arched (e.g., V-shaped notches will be formed in the concavities), which weakens the surface tension of lubricating oil and jeopardizes the effect as an oil reservoir, accordingly.

Reaction Process

After performing predetermined pre-treatment as described above or without carrying out pre-treatment, when a mixed fluid of fine-particle powders of soft metals and a compressed gas is collided with the surface of the sliding contact portion at an ejection pressure of 0.5 MPa or more or at an ejection speed of 200 m/s or more, the soft metals constituting the fine-particle powders are melted by heat generated at the time of collision and are adhered to the surface of the sliding contact portion, and furthermore, the soft metals constituting the fine-particle powders react with oxygen in the compressed gas (are oxidized) due to this heating.

Such metal oxides formed by reaction with oxygen are endowed with hardness significantly higher than that of their original soft metals, where one of the two metal oxides based on two respective soft metals exhibits relatively high hardness and the other exhibits relatively low hardness.

Therefore, an abrasion-resistant coating that mainly has relatively high hardness at the base material and relatively low hardness at the interface contacted with the object to be contacted serving as a counterpart to be contacted can be formed by colliding fine-particle powders of one soft metal that becomes a metal oxide with relatively high hardness with the surface of the above-described sliding contact portion and then colliding fine-particle powders of another soft metal that becomes a metal oxide with relatively low hardness with the surface of the above-described sliding contact portion, or alternatively, by colliding a mixture of fine-particle powders of the two soft metals combined according to predetermined conditions with the surface of the above-described sliding contact portion. Thus, a coating having concentrated shear fractures is formed at the interface contacted with the object to be contacted.

The "oxide film" formed by collision with the surface of the above-described sliding contact portion at an ejection pressure of 0.5 MPa or more or at an ejection speed of 200 m/s or more exhibits high adhesion strength to a sliding contact portion used for contact under high surface pressure. In addition, because a 0.1 μm to 1 μm coating, serving as the outermost surface of the "oxide film", that has low friction resistance and low shear resistance and concentrated shear fractures is formed, the contact surface area A of the portion condensed and solidified is decreased to reduce the friction, which makes it possible to form a high-lubricity "oxide film".

The "oxide film" formed in this manner is not worn out despite sliding contact with the object to be contacted serving as a counterpart to be contacted, and not only maintains high lubricity for an extended period of time but also prevents the object to be contacted serving as a counterpart to be contacted from being damaged.

It cannot be said that it is fully verified a process for preventing wear of the "oxide film" formed by the method according to the present invention whereby refraining from damage to the object to be contacted serving as a counterpart to be contacted. However, the coating according to the present invention is formed over the outermost surface of the "oxide film", wherein a metal oxide with relatively low hardness (e.g., zinc oxide) develops into transferred particles, which undergo repeated movement and transfer to exhibit lubricity, and therefore, it can be speculated that the "oxide film" is prevented from being worn away based on a mechanism whereby contacting with the object to be contacted, the transferred particles of a zinc oxide do not further harden by the effect of oxygen in the air at the friction surface, and therefore, can restore the original surface through movement and transfer, and then, the transferred particles are not ejected from between the interfaces in the form of abrasion powder, in other words, they remain between the interfaces to be contacted to prevent wear of the "oxide film".

In addition, because the transferred particles do not harden as described above, damage to the object to be contacted, which would occur if the transferred particles hardened, can be successfully avoided.

Because the outermost surface of the "oxide film" according to the present invention is formed of a metal oxide with relatively low hardness, such as a zinc oxide, it is difficult for the "oxide film" to further combine with oxygen. As a result, even if the object to be contacted serving as a counterpart to be contacted is formed of oxide ceramic, such as alumina ($Al_2O_3$) or silica ($SiO_2$), or is coated with such oxide ceramic, the adhesion is weak enough to afford the advantage of reduced friction.

Furthermore, because a zinc oxide is a stable (low-activity) substance compared with zinc that is not oxidized, the adhesion to an object to be contacted formed of carbide-based ceramic, such as silicon carbide (SiC), or an object to be contacted coated with carbide-based ceramic is decreased. As a result, the frictional force with such an object to be contacted will also be reduced.

DETAILED DESCRIPTION OF THE PREFERRED EMBODIMENTS

Embodiment 1

Coating Test on the Skirt Part of an Engine Piston

An "oxide film" was formed over the piston skirt part (made of cast Al—Si alloy (AC8A)) of the aluminum engine of a racing motorcycle by the method according to the present invention. The processing conditions are shown in Table 1.

TABLE 1

Formation of an "oxide film" over an engine skirt part

| Product to be treated | | |
|---|---|---|
| Name | Piston skirt part | |
| Material | Aluminum alloy (AC8A) | |
| Hardness | Hv | |
| Pre-treatment | None | |
| Processing based on the present invention | Blasting machine: gravity type (simultaneous ejection of the following two types of powders) or | |
| | First process: gravity type | Second process: gravity type |
| Ejected powders | | |
| Material | Sn | Zn |
| Specific gravity | 7.298 | 7.133 |
| Melting point | 231.9° C. | 419.46° C. |
| Hardness (Mohs) | 3 to 2 | 4 |
| Post-oxidation hardness | Hv1650 | Hv200 |
| Average particle diameter | 40 μm | 55 μm |
| Shape | Substantially spherical shape | |
| Ejection pressure | 0.7 MPa | |

TABLE 1-continued

| Formation of an "oxide film" over an engine skirt part | | |
|---|---|---|
| Ejection conditions | | |
| Ejection speed | About 240 m/s | About 220 m/s |
| Nozzle diameter | 9 mm | |
| Ejection distance | 150 mm | |
| Ejection time | 90 sec for the skirt part that is 85 mm diameter × 50 mm long | |

One kilogram of tin powder and 1 kg of zinc powder were mixed and collided with the skirt part of the piston to form an "oxide film".

It was confirmed that an "oxide film" was formed over the post-processed piston skirt part such that a large amount of tin oxide existed at the base material and a large amount of zinc oxide existed at the surface.

It was confirmed that a large number of concavities semi-arched in cross section were formed on the surface of the piston skirt part covered with the "oxide film".

For the aluminum engine provided with the piston, serving as the object to be processed in this Embodiment, the piston and the cylinder block were formed of aluminum alloy and the cylinder inner wall surface was plated with nickel.

If the piston in this aluminum engine is used without being subjected to any processing, the above-described cylinder liner will be severely worn out and needs to be replaced for each race.

As listed in Table 1, the above-described two types of ejected powders may be ejected as a first process and a second process, respectively.

The collision speed or ejection speed of Zn was lower than that of Sn because the average particle diameter of Zn was larger than that of Sn. As a result, a larger amount of Zn could be distributed over the outermost surface of the interface contacted with the object to be contacted.

After the race was completed, the skirt part of the piston covered with an "oxide film" was observed, and the inner wall surface of the cylinder liner was checked. No wear was discovered at the piston skirt part. In addition, it was confirmed that a large number of concavities, arched in cross section, formed on the surface of the skirt part functioned as oil reservoirs to form an oil film at the skirt part of the piston.

Furthermore, wear of the inner wall surface of the cylinder liner was evidently reduced compared with a case where an unprocessed piston was used. Wear found on the inner wall surface of the cylinder liner was so slight that the same cylinder liner could be reused.

In contrast, for the piston of a racing motorcycle in which only tin powder was collided with the piston skirt part under the same conditions as those of the above-described method, although wear of the piston itself was reduced, such excessive wear was found on the cylinder liner, thus the cylinder liner needed to be replaced after each race.

Embodiment 2

Coating Test on a Gauge Pocket Punch

After a gauge pocket punch (powdered high-speed-steel sinter: HAP40) for an FHP plank for manufacturing automotive parts was subjected to the pre-treatment shown in Table 2 below, an "oxide film" was formed by the method according to the present invention.

TABLE 2

| Formation of an "oxide film" over a gauge pocket punch | | |
|---|---|---|
| Product to be treated | | |
| Name | Gauge pocket punch | |
| Material | Powdered high-speed steel (HAP40) | |
| Hardness | Hv800 (hardness after pre-treatment Hv1200) | |
| Pre-treatment | Blasting machine for fine powders | |
| Ejected powders | | |
| Material | Alumina-silica beads | |
| Average particle diameter | 40 μm | |
| Shape | Spherical shape | |
| Ejection conditions | | |
| Ejection pressure | 0.4 MPa | |
| Ejection speed | About 240 m/s | |
| Nozzle diameter | 9 mm | |
| Ejection distance | 100 mm | |
| Ejection time: | 30 sec, 2 directions | |
| Processing based on the present invention | Blasting machine | |
| | First process: gravity type | Second process: gravity type |
| Ejected powders | | |
| Material | Sn | Zn |
| Average particle diameter | 40 μm | |
| Shape | Substantially spherical shape | |
| Ejection pressure | 0.7 MPa | |
| Ejection conditions | | |
| Ejection speed | about 240 m/s | |
| Nozzle diameter | 9 mm | |
| Ejection distance | 150 mm | |
| Ejection time | 30 sec × 2 directions, 30 sec × 2 directions | |

As shown in Table 2, tin powder was first ejected onto the punch that had been subjected to predetermined pre-treatment, and then zinc powder was collided with the punch to form an "oxide film" over the surface of the sliding contact portion of the punch.

The punch, serving as the object to be processed, is used to perform blanking of an FHP plank for manufacturing automotive parts. It has a relatively short service life and is likely to be damaged due to friction, in particular, as a result of the FHP material being deposited onto the side of the punch.

Thus, this punch, if not subjected to any processing, reaches its service life after about 12,000 blanking operations.

In contrast, the punch that was covered with an "oxide film" by the above-described method according to the present invention was able to endure 60,000 blanking operations as a result of a reduction in the amount of deposition of the material. Furthermore, despite such an increased number of blanking operations, the blanked shape of the gauge pocket was better formed and the gauge pocket suffered from less burrs.

Blanking operations were performed using a punch that had been subjected to only pre-treatment among the processing operations listed in Table 2. The result was that the service life of this punch was extended to 24,000 blanking operations. In short, the punch that had been subjected to only pre-treatment was not able to endure so many blanking operations as a punch that was covered with an "oxide film" abrasion-resistant lubricant coating according to the present invention.

Embodiment 3

Coating Test on a Gear Rolling Die

A gear rolling die made of matrix high-speed steel ("YXR33" manufactured by Hitachi Metals, Ltd.) was covered with an "oxide film" under the following conditions.

TABLE 3

| Formation of an "oxide film" over a gear rolling die | | |
|---|---|---|
| Product to be treated | | |
| Name: | Gear rolling die | |
| Material | Matrix high-speed steel ("YXR33" manufactured by Hitachi Metals, Ltd.) | |
| Hardness | Hv600 (hardness after pre-treatment Hv800) | |
| Pre-treatment | | |
| Blasting machine | First process: gravity type | Second process: gravity type |
| Ejected powders | | |
| Material | High-speed steel | Alumina-silica beads |
| Average particle diameter | 55 μm | 40 μm |
| Shape | Spherical shape | |
| Ejection conditions | | |
| Ejection pressure | 0.5 MPa | 0.4 MPa |
| Ejection speed | About 150 m/s | About 240 m/s |
| Nozzle diameter | 9 mm | |
| Ejection distance | 100 mm | |
| Ejection time | 5 min × 3 directions | About 3 min × 3 directions |
| Processing based on the present invention | Blasting machine | |
| | First process: direct-pressure type | Second process: gravity type |
| Material | Sn | Zn |
| Average particle diameter | 50 μm | 40 μm |
| Shape | Substantially spherical shape | |
| Ejection pressure | 0.5 MPa | 0.7 MPa |
| Ejection conditions | | |
| Ejection speed | About 250 m/s | About 240 m/s |
| Nozzle diameter | 5 mm | 9 mm |
| Ejection distance | 200 mm | 150 mm |
| Ejection time | 10 min × 3 directions | 5 min × 3 directions |

As shown in Table 3, after two-step pre-treatment was performed using different types of shot, blasting by the use of tin powder and blasting by the use of zinc powder were performed in different processes to form an abrasion-resistant coating made of "oxide film".

In an unprocessed state, the gear rolling die, serving as the object to be processed, endures about 5,000 operations. The gear rolling die covered with an "oxide film" by the method shown in Table 3 was able to endure up to 100,000 operations. As a result, mass production of gears was made possible without having to replace the die.

Although even the two-step pre-treatment alone shown in Table 3 was able to extend the service life of the gear rolling die, extension of the service life resulting from pre-treatment alone was up to 40,000 operations.

Embodiment 4

Formation of a Coating Over the Joint of a Tool Shank

An "oxide film" was formed over the joint of a tool shank made of tempered carbon steel (S45C) under the conditions listed in Table 4.

TABLE 4

| Formation of an "oxide film" over the tool shank joint | | |
|---|---|---|
| Product to be treated | | |
| Name | Joint of tool shank | |
| Material | Carbon steel (S45C), tempered part | |
| Hardness | Hv450 (hardness after pre-treatment Hv650) | |
| Pre-treatment | Blasting machine: gravity type | |
| Ejected powders | | |
| Material | High-speed steel | |
| Average particle diameter | 55 μm | |
| Shape | Spherical shape | |
| Ejection conditions | | |
| Ejection pressure | 0.5 MPa | |
| Ejection speed | About 150 m/s | |
| Nozzle diameter | 9 mm | |
| Ejection distance | 100 mm | |
| Ejection time | About 3 min | |
| Processing based on the present invention | Blasting machine | |
| | First process: gravity type | Second process: gravity type |
| Ejected powders | | |
| Material | Sn | Zn |
| Average particle diameter | 40 μm | |
| Shape | Substantially spherical shape | |
| Ejection pressure | 0.7 MPa | |
| Ejection conditions | | |
| Ejection speed | About 240 m/s | |
| Nozzle diameter | 9 mm | |
| Ejection distance | 150 mm | |
| Ejection time | About 6 min | |

An unprocessed tool shank is problematic in that loud noise is generated from the joint. In addition, an unprocessed tool shank has a relatively short service life due to excessive wear; more specifically, it can endure only about $10^6$ operations. A tool shank having a joint covered with an "oxide film" formed under the conditions listed in Table 4 had an extended service life of $10^7$ operations. Furthermore, neither noise nor excessive wear was observed.

A tool shank that has been subjected to only the pre-treatment listed in Table 4 was not able to demonstrate significant extension of service life. A tool shank that has been subjected to only ejection processing of tin powder was able to demonstrate only slight extension of service life, and the oil film was found to run out, preventing grease applied to the joint from being distributed over the entire surface.

Embodiment 5

Abrasion-Loss Measurement Test

A rotating ring serving as an object to be contacted was brought into contact with a test piece covered with an "oxide film" formed by the method according to the present invention, and the abrasion loss of the ring and test piece were measured.

The conditions for forming the "oxide film" over the test piece are listed in Table 5.

TABLE 5

| Processing conditions of test piece | | |
|---|---|---|
| Test piece | | |
| Material | Aluminum die-casting product (APC12) | |
| Hardness | Hv180 (hardness after pre-treatment Hv650) | |
| Pre-treatment | Blasting machine: gravity type | |
| Ejected powders | | |
| Material | Alumina-silica beads | |
| Average particle diameter | 40 μm | |
| Shape | Spherical shape | |
| Ejection conditions | | |
| Ejection pressure | 0.4 MPa | |
| Ejection speed | About 240 m/s | |
| Nozzle diameter | 9 mm | |
| Ejection distance | 100 mm | |
| Ejection time | About 20 sec | |
| Processing based on the present invention | Blasting machine | |
| | First process: gravity type | Second process: gravity type |
| Ejected powders | | |
| Material | Sn | Zn |
| Average particle diameter | 40 μm | |
| Shape | Substantially spherical shape | |
| Ejection conditions | | |
| Ejection pressure | 0.7 MPa | |
| Ejection speed | About 240 m/s | |
| Nozzle diameter | 9 mm | |
| Ejection distance | 150 mm | |
| Ejection time | About 40 sec | |

Figure 1:
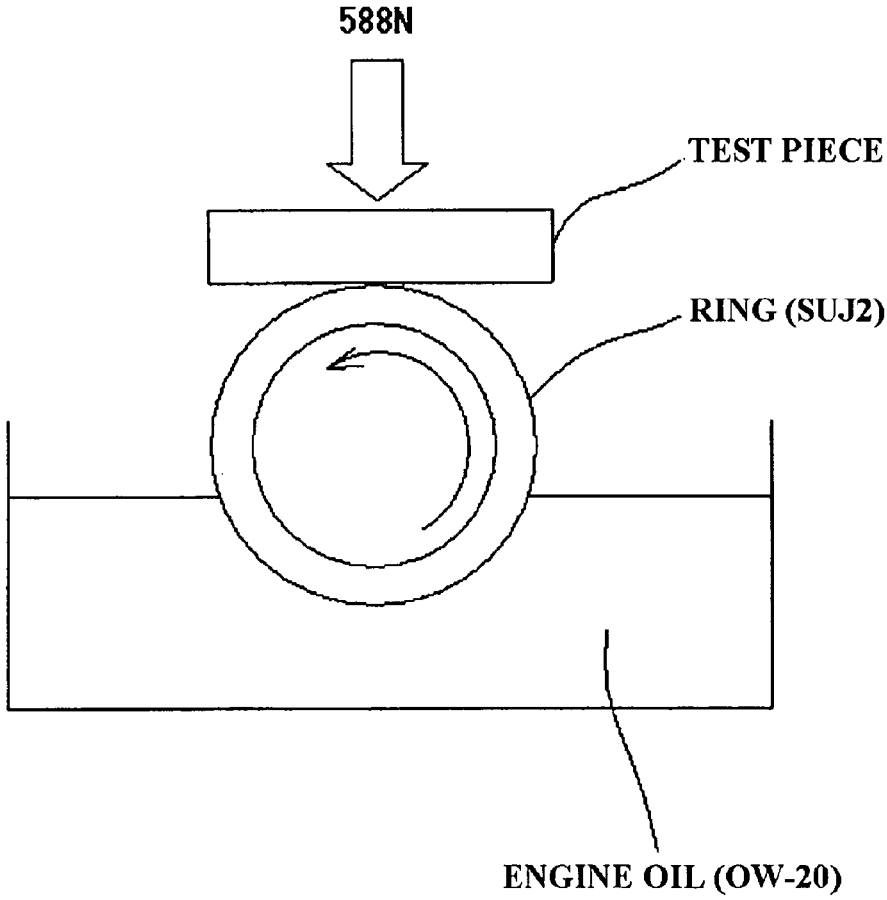
FIG. 1 is a diagram for explaining a test procedure according to Embodiment 5.

Partially immersed in a lubricating oil (OW-20 engine oil, used at room temperature without temperature adjustment) as shown in FIG. 1, a test piece covered with an "oxide film" formed according to the processing conditions listed in Table 5 (Embodiment) was brought into sliding contact with a ring made of high-carbon chromium bearing steel (SUJ2) and rotating at a rate of 160 $min^{-1}$.

The test piece was kept in contact with the ring at a pressure of 588 N for 30 seconds.

The abrasion losses of the test piece and the ring were measured by comparing their respective weights before and after the test was conducted.

As comparative examples, an unprocessed test piece (Comparative Example 1), a test piece that had been subjected to only the pre-treatment listed in Table 5 (Comparative Example 2), and a test piece that had been subjected to the pre-treatment and ejection of tin powder listed in Table 5 (Comparative Example 3) were pressed onto the ring in the same manner to measure the abrasion loss.

Figure 2:
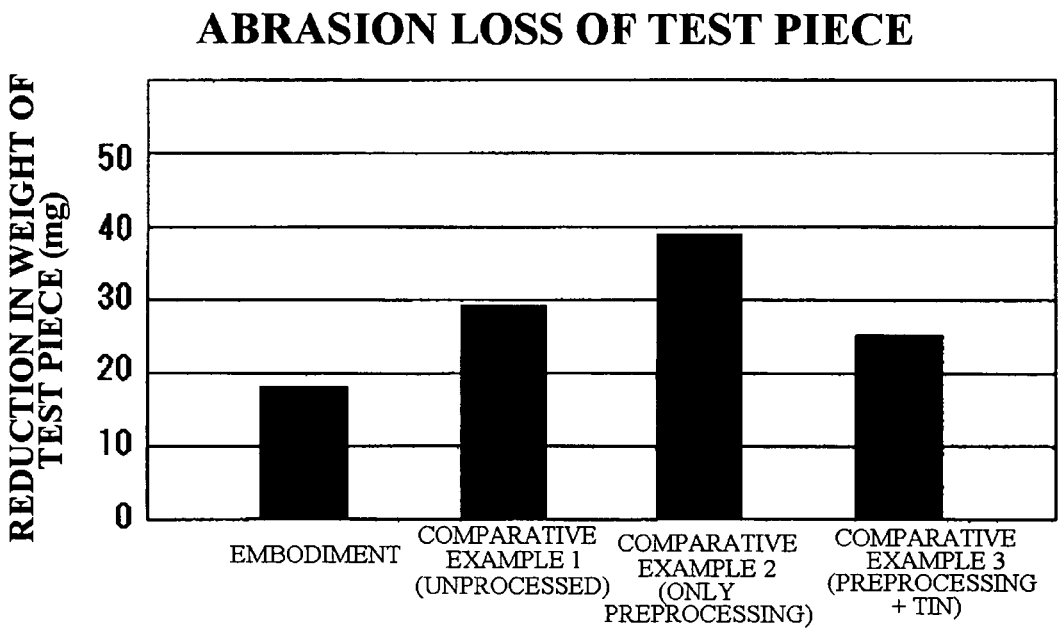
FIG. 2 is a graph showing measured abrasion loss of a test piece (Embodiment 5).
Figure 3:
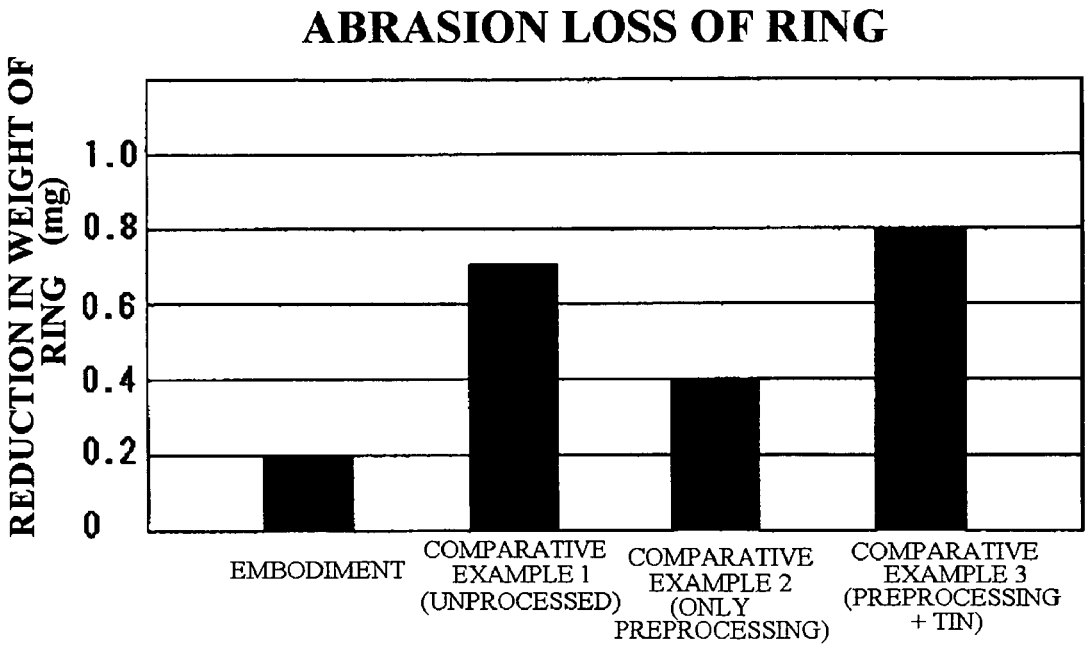
FIG. 3 is a graph showing measured abrasion loss of a ring (Embodiment 5).

The abrasion loss of the test pieces in the Embodiments and Comparative Examples 1 to 3 is shown in FIG. 2, and the abrasion loss of the ring onto which the test pieces were pressed is shown in FIG. 3.

As shown in FIG. 2, for the abrasion loss of the test pieces, the test piece in the Embodiment experienced least wear. The abrasion loss of the test pieces increases in the following order: the test piece in Comparative Example 3 (pre-treatment+tin ejection), the test piece in Comparative Example 1 (unprocessed), and the test piece in Comparative Example 2 (only pre-treatment).

On the other hand, as shown in FIG. 3, for the abrasion loss of the ring serving as a counterpart to be contacted, the ring as brought into contact with the test piece in the Embodiment experienced least wear. The abrasion loss of the ring increases in the following order: the ring in contact with the test piece in Comparative Example 2 (only pre-treatment), the ring in contact with the test piece in Comparative Example 1 (unprocessed), and the ring in contact with the test piece in Comparative Example 3 (pre-treatment+tin ejection).

From the comparison test results described above, for the test piece that had been subjected to only pre-treatment (Comparative Example 2), the abrasion loss of the test piece itself increased compared with even the unprocessed test piece (Comparative Example 1), though the counterpart to be contacted (rotating ring) was successfully prevented from being worn out.

Furthermore, for the test piece that had been subjected to ejection of tin powder after pre-treatment (Comparative Example 3), the abrasion loss of the partner (ring) increased more than in the case where the unprocessed test piece was used (Comparative Example 1), though the abrasion loss of the test piece itself decreased. In short, for the test piece in Comparative Example 3, it was not possible to increase the abrasion resistance and the lubricity of both the members (test piece and ring) in sliding contact with each other.

In contrast, for the test piece covered with an "oxide film" (Embodiment), not only the test piece itself but also the counterpart to be contacted (rotating ring) could be prevented from being worn out. In short, it was possible to prevent both the members (test piece and ring) in sliding contact with each other from being worn out.

The "oxide film" described above and the method for forming the same can be applied to various types of articles used in sliding contact with an object to be contacted; mechanical parts including the piston of an engine, the joint of a tool shank, a shaft, and a bearing; blanking, bending, or cutting tools including a punch, a bender, and a die; molds for drawing and bending; and so forth.

The "oxide film" described above and the method for forming the same can also be applied to various types of devices that can exhibit excellent lubricity even when used without a fluid lubricant, such as oil and grease, and that are likely to be used under vacuum.

Thus, the broadest claims that follow are not directed to a machine that is configuration a specific way. Instead, said broadest claims are intended to protect the heart or essence of this breakthrough invention. This invention is clearly new and useful. Moreover, it was not obvious to those of ordinary skill in the art at the time it was made, in view of the prior art when considered as a whole.

Moreover, in view of the revolutionary nature of this invention, it is clearly a pioneering invention. As such, the claims that follow are entitled to very broad interpretation as to protect the heart of this invention, as a matter of law.

It will thus be seen that the objects set forth above, and those made apparent from the foregoing description, are efficiently attained. Also, since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween. Now that the invention has been described;

What is claimed is:

1. A surface-oxide abrasion-resistant lubricant coating formed of two metal oxides that are produced as a result of a mixture of fine-particle powders of two respective soft metals, each having lower hardness and lower melting point than a base material of a sliding contact portion to be lubricated, the sliding contact portion being adapted to slidingly contact an object to be contacted and where the fine-particle powders are caused to be mixed by colliding the fine-particle powders against a surface of the sliding contact portion with a compressed gas containing oxygen to cause oxidation of the same at the surface of the sliding contact portion such that one of the two metal oxides has relatively higher hardness than the other;

the surface-oxide abrasion-resistant lubricant coating including a high-hardness portion and a low-hardness portion which has relatively lower hardness than the high-hardness portion;

the high-hardness portion being formed at a side of the base material of the sliding contact portion;

the low-hardness portion being formed with a thickness of 0.1 μm to 2 μm at an interface which is located between the sliding contact portion that contacts the object to be contacted and a side of the object to be contacted and wherein the interface is a surface of the surface-oxide abrasion-resistant lubricant coating, the low-hardness portion having decreased friction resistance and shear resistance, and shear fractures concentrated to the low-hardness portion, the fine-particle powder of the soft metal that becomes a metal oxide of relatively higher hardness having a particle diameter smaller than the particle diameter of the fine-particle powder of the soft metal that becomes a metal oxide of relatively lower hardness;

the low-hardness portion of the surface-oxide abrasion-resistant lubricant coating being formed of the metal oxides, one of the metal oxides having relatively higher hardness and the other having relatively lower hardness as a result of oxidation during colliding, and coverage of the metal oxide with relatively lower hardness at the low-hardness portion being at least 80%.

2. A surface-oxide abrasion-resistant lubricant coating formed of two metal oxides that are produced as a result of fine-particle powders of two respective soft metals, each of the soft metals having lower hardness and lower melting point than a base material of a sliding contact portion to be lubricated, the sliding contact portion being adapted to slidingly contact an object to be contacted and where the fine-particle powders are caused to be to be oxidized by colliding the fine-particle powder of the soft metal that becomes a metal oxide with relatively high hardness as a result of oxidation with a compressed gas containing oxygen against the surface of the sliding contact portion and then by colliding the fine-particle powder of the soft metal that becomes a metal oxide with relatively low hardness as a result of oxidation with the compressed gas containing oxygen against the surface of the sliding contact portion such that one of the two metal oxides has higher hardness than the other, the surface-oxide abrasion-resistant lubricant coating has a two-layer structure including:

a high-hardness portion formed of the metal oxide having relatively higher hardness formed over the base material; and a low-hardness portion formed of the metal oxide having relatively lower hardness formed over the high-hardness portion, and the low-hardness portion having relatively low hardness than the high-hardness portion, and having decreased friction resistance and shear resistance, and shear fractures concentrated to the low-hardness portion, and the low-hardness portion having a thickness of 0.1 μm to 2 μm.

3. The surface-oxide abrasion-resistant lubricant coating according to claim 1, wherein the metal oxide with relatively lower hardness has a hardness that is equal to or less than one-fourth of the hardness of the metal oxide with relatively higher hardness.

4. The surface-oxide abrasion-resistant lubricant coating according to claim 2, wherein the metal oxide with relatively lower hardness has a hardness that is equal to or less than one-fourth of the hardness of the metal oxide with relatively higher hardness.

5. The surface-oxide abrasion-resistant lubricant coating according to claim 1, wherein the hardness of the base material is equal to or more than Hv450, and a large number of concavities having a diameter of 0.1 μm to 5 μm and arched in cross section are formed on the sliding contact portion.

6. The surface-oxide abrasion-resistant lubricant coating according to claim 2, wherein the hardness of the base material is equal to or more than Hv450, and a large number of concavities having a diameter of 0.1 μm to 5 μm and arched in cross section are formed on the sliding contact portion.

7. A method for forming a surface-oxide abrasion-resistant lubricant coating, the method comprising the steps of:

providing a compressed gas that contains oxygen;

colliding a mixed fluid consisting of the compressed gas containing oxygen and fine-particle powders of two respective soft metals each having a lower hardness and lower melting point than a base material of a sliding contact portion to be lubricated against a surface of the sliding contact portion at an ejection pressure of 0.5 MPa or more or at an ejection speed of 200 m/sec or more;

reacting the fine-particle powders of the two respective soft metals with the oxygen in the compressed gas so as to cause oxidation at the surface of the sliding contact portion to produce two metal oxides, such that one of the two metal oxides has relatively higher hardness than the other; and forming a surface-oxide abrasion-resistant lubricant coating formed of the two metal oxides, the surface-oxide abrasion-resistant lubricant coating including a high-hardness portion and a low-hardness portion which has relatively lower hardness than the high-hardness portion, the high-hardness portion being formed at a side of the base material of the sliding contact portion;

the low-hardness portion with a thickness of 0.1 μm to 2 μm at an interface which is located between the sliding contact portion that contacts the object to be contacted and a side of an object to be contacted and wherein the interface is a surface of the surface-oxide abrasion-resistant lubricant coating, the low-hardness portion having decreased friction resistance and shear resistance, and shear fractures concentrated to the low-hardness portion, the fine-particle powder of the soft metal that becomes a metal oxide of relatively higher hardness having a particle diameter smaller than the particle diameter of the fine-particle powder of the soft metal that becomes a metal oxide having relatively lower hardness, and the ejection speed of the fine-particle powder of the soft metal that becomes the metal oxide having relatively lower hardness is relatively lower than the ejection speed of the fine-particle powder of the soft metal that becomes the metal oxide having relatively higher hardness, and the low-hardness portion of the surface-oxide abrasion-resistant lubricant coating being formed of the metal oxides, one of the metal oxides having relatively higher relatively hardness and the other having relatively lower hardness as a result of oxidation during colliding, and coverage of the metal oxide with relatively lower hardness at the low-hardness portion being at least 80%.

8. The method for forming a surface-oxide abrasion-resistant lubricant coating according to claim 7, wherein an average particle diameter of the fine-particle powders of soft metals is 10 μm to 100 μm.

9. The method for forming a surface-oxide abrasion-resistant lubricant coating according to claim 7, wherein a combination of the two soft metals is selected so that at least one of the hardness, density, specific gravity and melting point of each of the two soft metals are essentially the same.

10. The method for forming a surface-oxide abrasion-resistant lubricant coating comprising the steps of:

providing a compressed gas that contains oxygen, using the compressed gas containing oxygen to collide a fine-particle powder of a soft metal having lower hardness and lower melting point than a base material of a sliding contact portion to be lubricated against a surface of the sliding contact portion so that it becomes a metal oxide with relatively higher hardness as a result of oxidation at the surface of the sliding contact portion to be lubricated, and at an ejection pressure of 0.5 MPa or more or at an ejection speed of 200 m/sec or more to form a high-hardness portion, using the compressed gas containing oxygen to collide a fine-particle powder of a soft metal having lower hardness and lower melting point than the base material of the sliding contact portion to be lubricated against the high-hardness portion so that it becomes a metal oxide with relatively lower hardness as a result of oxidation at the high-hardness portion at an ejection pressure of 0.5 MPa or more or at an ejection speed of 200 m/sec or more to form a low-hardness portion which has relatively lower hardness than the high hardness portion, the lower hardness-portion having a thickness of 0.1 μm to 2 μm, and having decreased friction resistance and shear resistance, and shear fractures concentrated to the low-hardness portion.

11. The method for forming a surface-oxide abrasion-resistant lubricant coating according to claim 7, wherein a soft metal that has lower density or lower specific gravity than the soft metal that becomes the metal oxide with relatively higher hardness as a result of oxidation is selected as the soft metal that becomes the metal oxide with relatively lower hardness as a result of oxidation.

12. The method for forming a surface-oxide abrasion-resistant lubricant coating according to claim 7, wherein the sliding contact portion whose base material has a hardness of Hv450 or more is subjected to pre-treatment by colliding shots having a particle diameter of 20 μm to 200 μm and hardness equal to or higher than the hardness of the base material of the sliding contact portion and that are substantially spherical shape with the surface of the sliding contact portion at an ejection speed of 100 m/sec to 250 m/sec or at an ejection pressure of 0.3 MPa to 0.6 MPa in one or more processes to form a large number of concavities having a diameter of 0.1 μm to 5 μm and arched in cross section on the surface of the sliding contact portion.

13. The surface-oxide abrasion-resistant lubricant coating according to claim 1, wherein the low-hardness portion is formed of the two metal oxides, one of the metal oxides having relatively higher hardness and the other having relatively lower hardness as a result of oxidation, coverage of the metal oxide with relatively lower hardness at the low hardness portion is at least 50% and the low-hardness portion has a thickness of 0.1 μm to 1 μm.

14. The surface-oxide abrasion-resistant lubricant coating according to claim 3, wherein the low-hardness portion is formed of the two metal oxides, one of the metal oxides having relatively higher hardness and the other having relatively lower hardness as a result of oxidation, coverage of the metal oxide with relatively lower hardness at the low-hardness portion is at least 50%, and the low-hardness portion has a thickness of 0.1 μm to 1 μm.

15. The surface-oxide abrasion-resistant lubricant coating according to claim 5, wherein the low-hardness portion is formed of the two metal oxides, one of the metal oxides having relatively higher hardness and the other having relatively lower hardness as a result of oxidation, coverage of the metal oxide with relatively lower hardness at the low-hardness portion is at least 50%, and the low-hardness portion has a thickness of 0.1 μm to 1 μm.

16. The method for forming a surface-oxide abrasion-resistant lubricant coating according to claim 7, wherein the low-hardness portion is formed of the two metal oxides, one of the metal oxides having relatively higher hardness and the other having lower hardness as a result of oxidation, coverage of the metal oxide with lower hardness at the low-hardness portion is at least 50%, and the low-hardness portion has a thickness of 0.1 μm to 1 μm.

17. The method for forming a surface-oxide abrasion-resistant lubricant coating according to claim 10, wherein an average particle diameter of the fine-particle powders of soft metals is 10 μm to 100 μm.

18. The method for forming a surface-oxide abrasion-resistant lubricant coating according to claim 10, wherein the sliding contact portion whose base material has a hardness of Hv450 or more is subjected to the following pre-treatment by colliding shots having a particle diameter of 20 μm to 200 μm and hardness equal to or higher than the hardness of the base material of the sliding contact portion and that are substantially spherical shape with the surface of the sliding contact portion at an ejection speed of 100 m/sec to 250 m/sec or at an ejection pressure of 0.3 MPa to 0.6 MPa in one or more processes to form a large number of concavities having a diameter of 0.1 μm to 5 μm and arched in cross section on the surface of the sliding contact portion.

* * * * *